US008692733B2

(12) United States Patent
Yang et al.

(10) Patent No.: US 8,692,733 B2
(45) Date of Patent: Apr. 8, 2014

(54) QUICK FABRICATION LNBF ASSEMBLY

(75) Inventors: Lan-Chun Yang, Hsinchu (TW); Hung-Yuan Lin, Hsinchu (TW); San-Yi Kuo, Hsinchu (TW); Hong-Long Chen, Hsinchu (TW); Hsin-Tang Liu, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 568 days.

(21) Appl. No.: 12/983,889

(22) Filed: Jan. 4, 2011

(65) Prior Publication Data

US 2011/0193766 A1 Aug. 11, 2011

(30) Foreign Application Priority Data

Feb. 9, 2010 (TW) ..... 99103923

(51) Int. Cl.
*H01Q 1/12* (2006.01)

(52) U.S. Cl.
USPC ..... 343/892; 343/840; 343/786; 343/760; 343/878

(58) Field of Classification Search
USPC ..... 343/840, 786, 760, 892, 878
See application file for complete search history.

*Primary Examiner* — Douglas W Owens
*Assistant Examiner* — Jae Kim
(74) *Attorney, Agent, or Firm* — Winston Hsu; Scott Margo

(57) ABSTRACT

A low noise block down-converter with integrated feed (LNBF) assembly includes an LNBF main body, a connection portion including at least one LNBF locating hole, a support arm including at least one support arm locating hole, at least one locating spring piece including a fix end fixed on the support arm and a locating protrusion, a holder, a holding cam, and a pivot for connecting the holding cam to the holder, wherein when the connection portion inserts into the support arm, each locating protrusion penetrates the corresponding support arm locating hole and the corresponding LNBF locating hole to fix relative position between the connection portion and the support arm, and the holding cam is rotated to make a perimeter of the holding cam abut against the support arm completely and retain each locating protrusions in a penetration state.

13 Claims, 11 Drawing Sheets

QUICK FABRICATION LNBF ASSEMBLY

BACKGROUND OF THE INVENTION

1. Field of the Invention

The invention relates to a low noise block down-converter with integrated feed (LNBF), and more particularly, to an LNBF capable of being quickly assembled and disassembled.

2. Description of the Prior Art

Satellite communication technology has advantages of wide coverage area and long distance linking, which is applied in many domains, such as in satellite broadcasts or communication systems. Thus, wherever you are (even on the ocean or in the desert), the satellite signal may be received by a corresponding antenna. Please refer to FIG. 1. FIG. 1 is a satellite communication receiving system 10 in the prior art. The satellite communication receiving system 10 includes a dish antenna 102, a Low Noise Block Down-converter with Integrated Feed (LNBF) 104, and a support arm 106. In the satellite communication receiving system 10, the paraboloid dish antenna 102 reflects the satellite signal onto the LNBF 104 located on the focal point of the dish antenna 102. The satellite signal is down converted to an intermediate frequency (IF) signal by the LNBF. After that, the IF signals are fed to a rear satellite receiver via coaxial cables for further processing. The support arm 106 is utilized for supporting the LNBF 104 and containing the coaxial cables. In practice, the dish antenna 102 and the LNBF 104 are usually placed outdoors in order to receive the satellite signal.

In general, the LNBF 104 and the support arm 106 are usually assembled in the field, and need to be used in an outdoor environment under various weather conditions. Therefore, as shown in FIG. 2, if a gap between the LNBF 104 and the support arm 106 is too large, the receiving performance of the satellite signal will be affected. In the prior art, a common method for assembly utilizes lockup screws for fastening the LNBF 104 to the support arm 106. However, the mentioned method may reduce assembly efficiency due to its complicated lockup process. Also, when the assembly environment is a high place, the worker needs to use tools to complete the assembly process on a ladder, which is dangerous for the worker.

SUMMARY OF THE INVENTION

It is therefore a primary objective of the claimed invention to provide a low noise block down-converter with integrated feed (LNBF) assembly capable of quick fabrication.

An embodiment of the invention discloses a low noise block down-converter with integrated feed (LNBF) capable of quick fabrication, which includes an LNBF main body, a connection portion extending from the LNBF main body, wherein the connection portion comprises a plurality of signal output units and at least one LNBF locating hole, a support arm comprising at least one support arm locating hole and a chamber capable of accommodating the connection portion for supporting the LNBF main body by connecting with the connection portion, at least one locating spring piece, wherein each of the locating spring pieces comprises a fixing end fixed to the support arm and a locating protrusion, a holder disposed on the support arm comprising a first holding hole and a second holding hole, a holding cam comprising a cam end, a shaft end, and a third holding hole, wherein the cam end forms an eccentric cam and the holding cam is capable of rotating about an axis to make the perimeter of the cam end to approach or leave the support arm when the shaft end is rotated, and a pivot for connecting the holding cam to the holder by passing through the first holding hole, the second holding hole, and the third holding hole, wherein when the connection portion is inserted into the chamber of the support arm, each of the locating protrusions of the at least one locating spring piece passes the corresponding support arm locating hole and the corresponding LNBF locating hole to fix relative position between the connection portion and the support arm, and the holding cam is rotated to make the perimeter of the cam end abut against the support arm completely and retain each of the locating protrusions in a penetration state.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
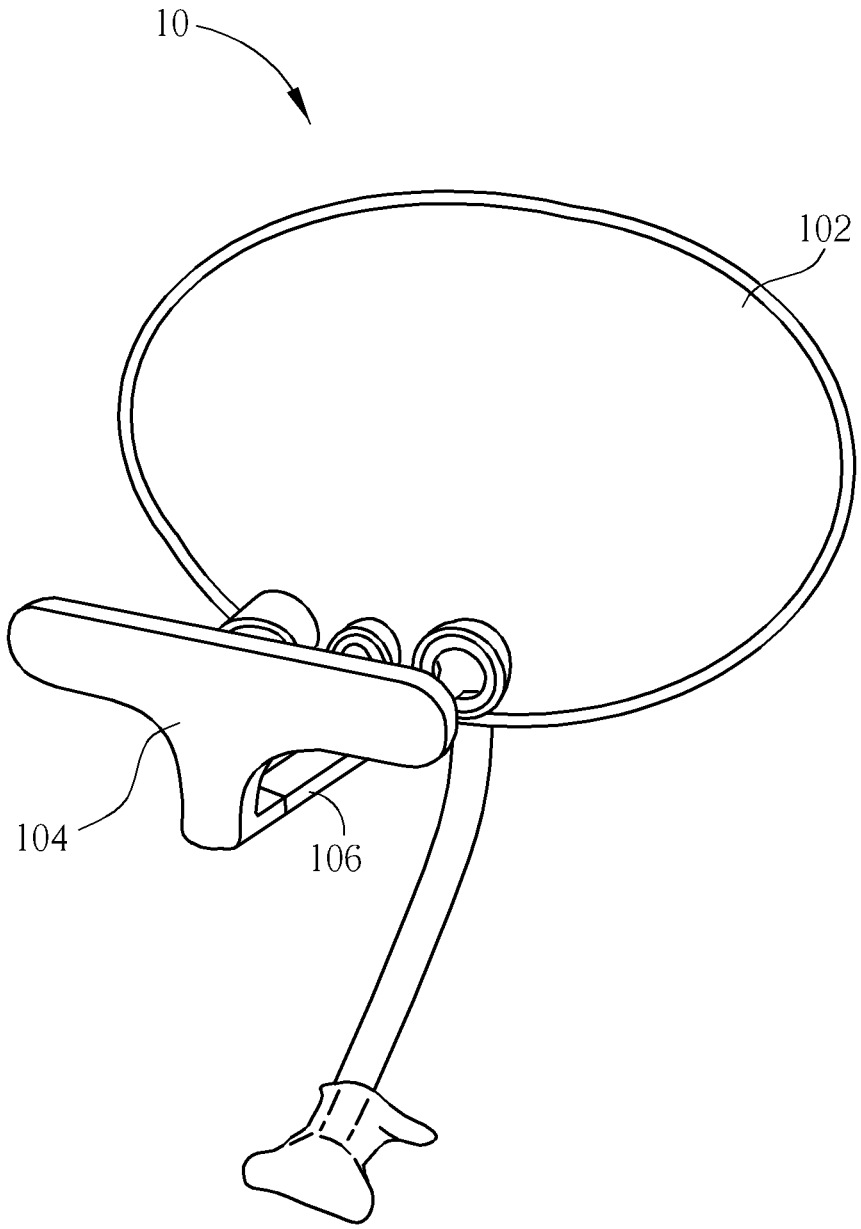
FIG. 1 PRIOR ART
FIG. 1 is a satellite communication receiving system in the prior art.
Figure 2:
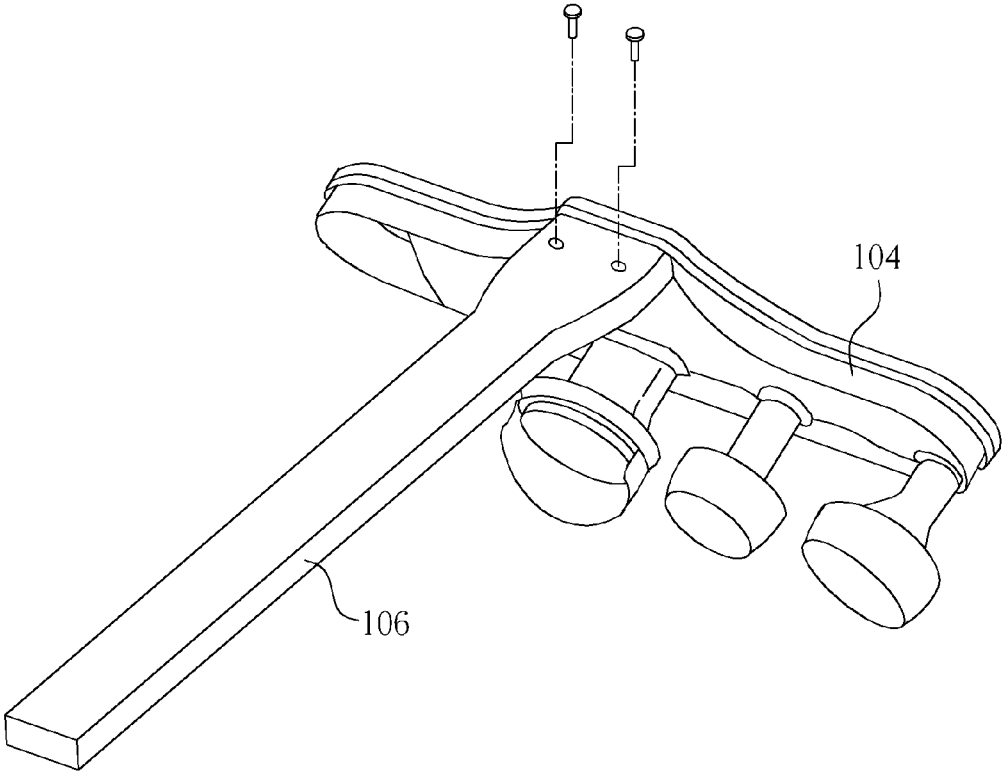
FIG. 2 PRIOR ART
FIG. 2 is a schematic diagram of an LNBF by using screws in the prior art.
Figure 3:
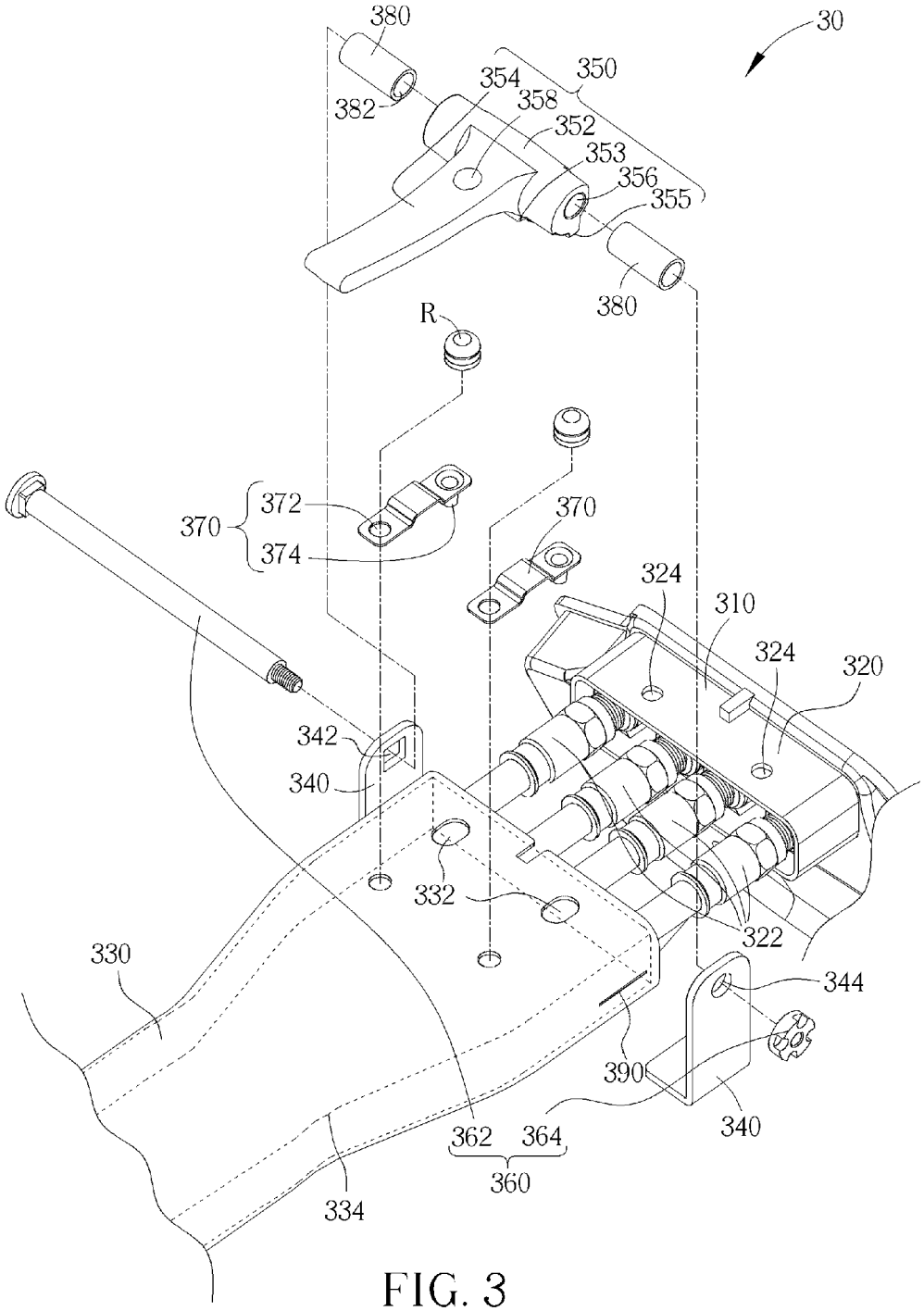
FIG. 3 is an exploded diagram of an LNBF assembly capable of quick fabrication according to an embodiment of the invention.

Please refer to FIG. 3. FIG. 3 is an exploded diagram of a low noise block down-converter with integrated feed (LNBF) assembly 30 capable of quick fabrication according to an embodiment of the invention. The LNBF assembly 30 includes an LNBF main body 310, a connection portion 320, a support arm 330, a holder 340, a holding cam 350, a pivot 360, fixing spring pieces 370, spacer bushings 380, and a protruding structure 390. The LNBF main body 310 is connected to the support arm 330 via the connection portion 320 for secure fixture at a focal point of the paraboloid satellite dish. The connection portion 320 extends from the LNBF main body 310, which includes a plurality of signal output units 322 and LNBF locating holes 324. The support arm 330 includes support arm locating holes 332 and a chamber 334 capable of accommodating the connection portion 320, which is utilized for supporting the LNBF main body 310 by connecting to the connection portion 320. Each fixing spring piece 370 includes a fixing end 372 fixed to the support arm 330 and a locating protrusion 374. Please note that the fixing end 372 of each fixing spring piece 370 can be fixed on the support arm 330 by any fastening method, such as spot soldering, riveting, or screwing. For example, as shown in FIG. 3, the LNBF assembly 30 utilizes rivets R to fix the fixing end 372 of the fixing spring pieces 370 on the support arm 330 by a riveting method. Moreover, when the connection portion 320 is inserted into the chamber 334, the locating protrusions 374 can pass through the corresponding support arm locating holes 332 and LNBF locating holes 324 to limit range of relative motion between the connection portion 320 and the support arm 330. In other words, relative position between the connection portion 320 and the support arm 330 can be fixed in the above-mentioned manner. Therefore, the fixing spring pieces 370 can also position the locating protrusions 374 in an engaged state with elastic restoring force after the locating protrusions 374 of the fixing spring pieces 370 have penetrated the corresponding support arm locating holes 332 and LNBF locating holes 324. In such a condition, the locating protrusions 374 of the fixing spring pieces 370 will not leave the corresponding support arm locating holes 332 and LNBF locating holes 324 without external force. Certainly, to ensure secure operation of the LNBF assembly 30 after assembly, please refer to the following description.

As shown in FIG. 3, the holder 340 is disposed on the support arm 330, which includes a first holding hole 342 and a second holding hole 344. The holding cam 350 includes a cam end 352, a shaft end 354, and a third holding hole 356, a constraining plane structure 353, and a position-limiting structure 355. The cam end 352 forms an eccentric cam. When the shaft end 354 is rotated, the holding cam 350 is capable of rotating about the third holding hole 356 (regarded as an axis of the cam end 352 while rotating) so that the perimeter of the cam end 352 can approach or leave the support arm 330 accordingly. In other words, according to an operation principle of the eccentric cam, the perimeter of the cam end 352 has various displacements by following the rotation operation condition of the holding cam 350. Therefore, when the locating protrusions 374 of the fixing spring pieces 370 have passed through the corresponding support arm locating holes 332 and LNBF locating holes 324, the shaft end 354 can be operated to make the perimeter of the cam end 352 contact with the support arm 330 (for example, the constraining plane structure 353 contacts the support arm 330) and the fixing spring pieces 370 (for example, the position-limiting structure 355 contacts the fixing spring pieces 370). In such a condition, the locating protrusions 374 are not able to cause too much displacement due to the obstruction of the position-limiting structure 355. So, through the design of the invention, the position-limiting structure 355 can prevent the locating protrusions 374 from departing the corresponding support arm locating holes 332 and LNBF locating holes 324 so as to achieve secure fabrication. Briefly, as the LNBF assembly 30 is assembled, the invention can limit the displacement travel of the locating protrusions 374 through adjusting the holding cam 350 to avoid the locating protrusions 374 departing the corresponding support arm locating holes 332 and LNBF locating holes so that the locating protrusions 374 can be kept in the penetration state.

In addition, the pivot 360 is utilized for connecting the holding cam 350 to the holder 340 by passing through the first holding hole 342, the second holding hole 344, the third holding hole 356 and the fourth holding hole 382. Therefore, through a simple operation, the pivot 360 is arranged to pass through the corresponding holding holes, and the holding cam 350 is capable of being installed on the holder 340 rapidly and securely.

Figure 4:
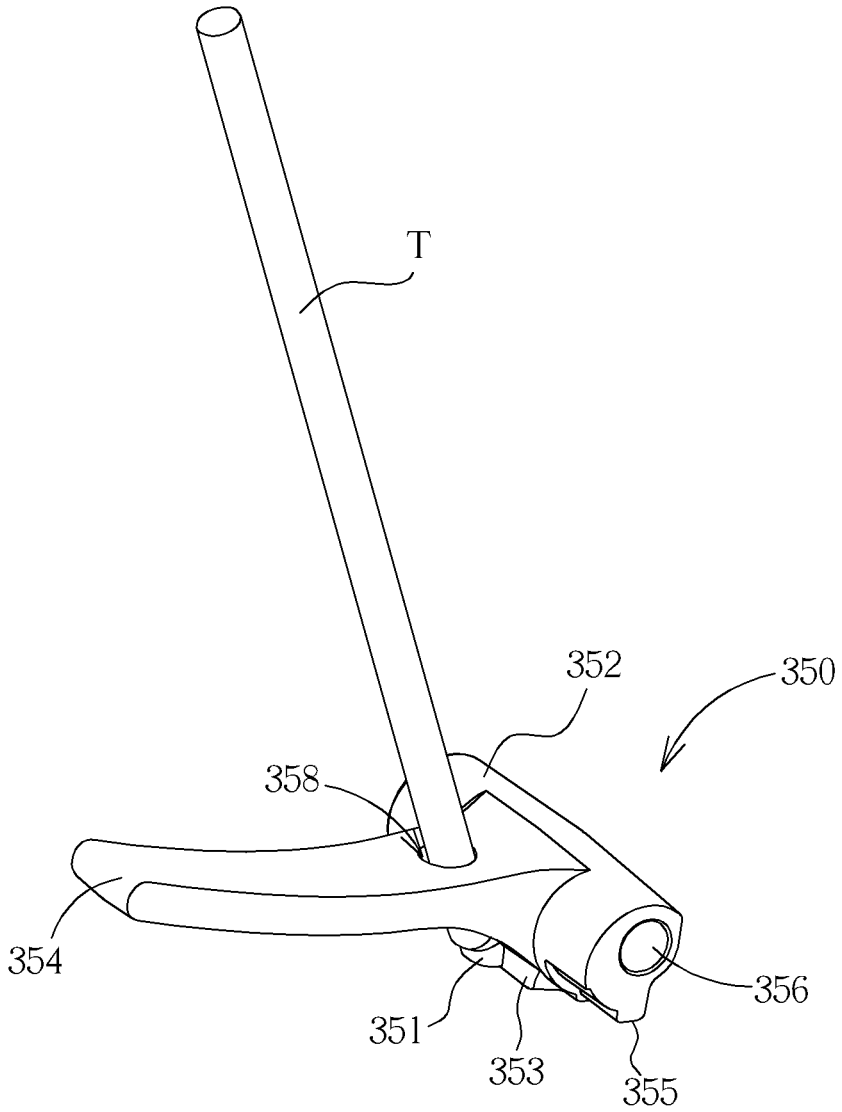
FIG. 4 is a schematic diagram of the holding cam 350 shown in FIG. 3.

As shape of the shaft end 354 of the holding cam 350 is longer, a user can save strength operating the shaft end 354 to rotate the holding cam 350. However, the longer shaft end 354 is easily misoperated, causing a holding failure accident. In such a situation, please refer to FIG. 3 and FIG. 4. FIG. 4 is a schematic diagram of the holding cam 350 shown in FIG. 3. The holding cam 350 further includes an insertion hole 358 and a stop component 351. The insertion hole 358 is disposed on the shaft end 354. The user can insert an auxiliary rod T into the insertion hole 358 and utilize the auxiliary rod T to drive the holding cam 350 to rotate about the axis so as to adjust the distance between the perimeter of the cam end 352 (i.e. the constraining plane structure 353 and the position-limiting structure 355) and the support arm 330. Furthermore, the stop component 351 is disposed nearby an opening of the insertion hole 358 for holding the auxiliary rod T to limit the position of the auxiliary rod T as the auxiliary rod T is inserted into the insertion hole 358. In other words, the stop component 351 is capable of assisting with locating and guiding the auxiliary rod T during assembly. With the design of the stop component 351, the user can rapidly insert the auxiliary rod T in position and rotate the holding cam 350 for quick assembly (or disassembly). Besides, because the stop component 351 is able to prevent the auxiliary rod T from over insertion, the auxiliary rod T will not scratch the face of the support arm 330 while being inserted into the insertion hole 358. With the design of the insertion hole 358 and the stop component 351, even if the shaft end 354 of the holding cam 350 is designed too short, the user can still easily drive the holding cam 350 via an auxiliary tool (such as the auxiliary rod T). In other words, through the above mentioned method, the invention can avoid misoperation due to a larger or longer shaft end 354, and the invention can provide a quick and simple fabrication operation by rapid insertion and pulling out of the auxiliary rod T.

Figure 5:
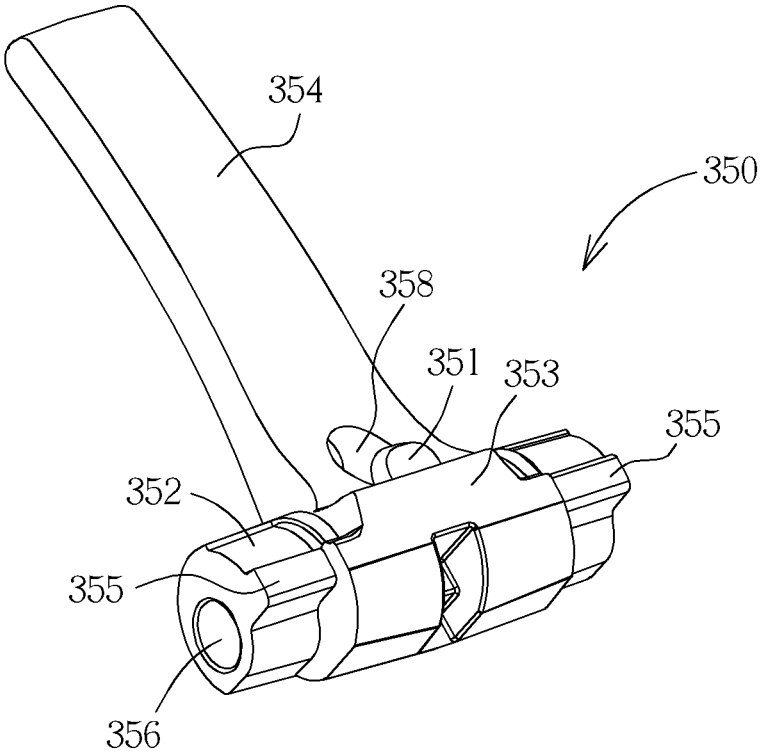
FIG. 5 is a schematic diagram of the constraining plane structure and the position-limiting structure shown in FIG. 3.

On the other hand, please refer to FIG. 5. FIG. 5 is a schematic diagram of the constraining plane structure 353 and the position-limiting structure 355 shown in FIG. 3. As shown in FIG. 5, the constraining plane structure 353 and the position-limiting structure 355 are disposed on the cam end 352 of the holding cam 350. In the invention, the constraining plane structure 353 is utilized for increasing the difficulty of rotating the holding cam 350 to prevent the holding cam 350 from being misoperated. For example, as shown in FIG. 5, the user requires more force for performing a rotation operation when the holding cam 350 is rotated from an angle of the constraining plane structure 353 to another angle. Thus, the constraining plane structure 353 can be a contact plane of the cam end 352 of the holding cam 350 during contact with the support arm 330 so that the holding cam 350 will not be turned after the cam end 352, i.e. the constraining plane structure 353, completely abuts against the support arm 330. Thus, compared with the prior art, the invention needs only insertion of the auxiliary rod T into the insertion hole 358 to drive the holding cam 350 easily and lightly for assembly without the complicated lockup process that involves heavy time and work requirements. Otherwise, through the design of the insertion hole 358 with the stop component 351 and the constraining plane structure 353, the invention can prevent misoperation of the holding cam 350 effectively. Moreover, through the design of the position-limiting structure 355, the holding cam 350 can align the fixing spring pieces 370 accurately and prevent the locating protrusions 374 from departing the corresponding support arm locating holes 332 and LNBF locating holes 324. In such a condition, the position-limiting structure 355 can prevent each of the locating protrusions 374 of the fixing spring pieces 370 from departing the corresponding support arm locating hole 332 and the corresponding LNBF locating hole 324, and also retain each of the locating protrusions 374 in a penetration state for positioning purposes.

Figure 6:
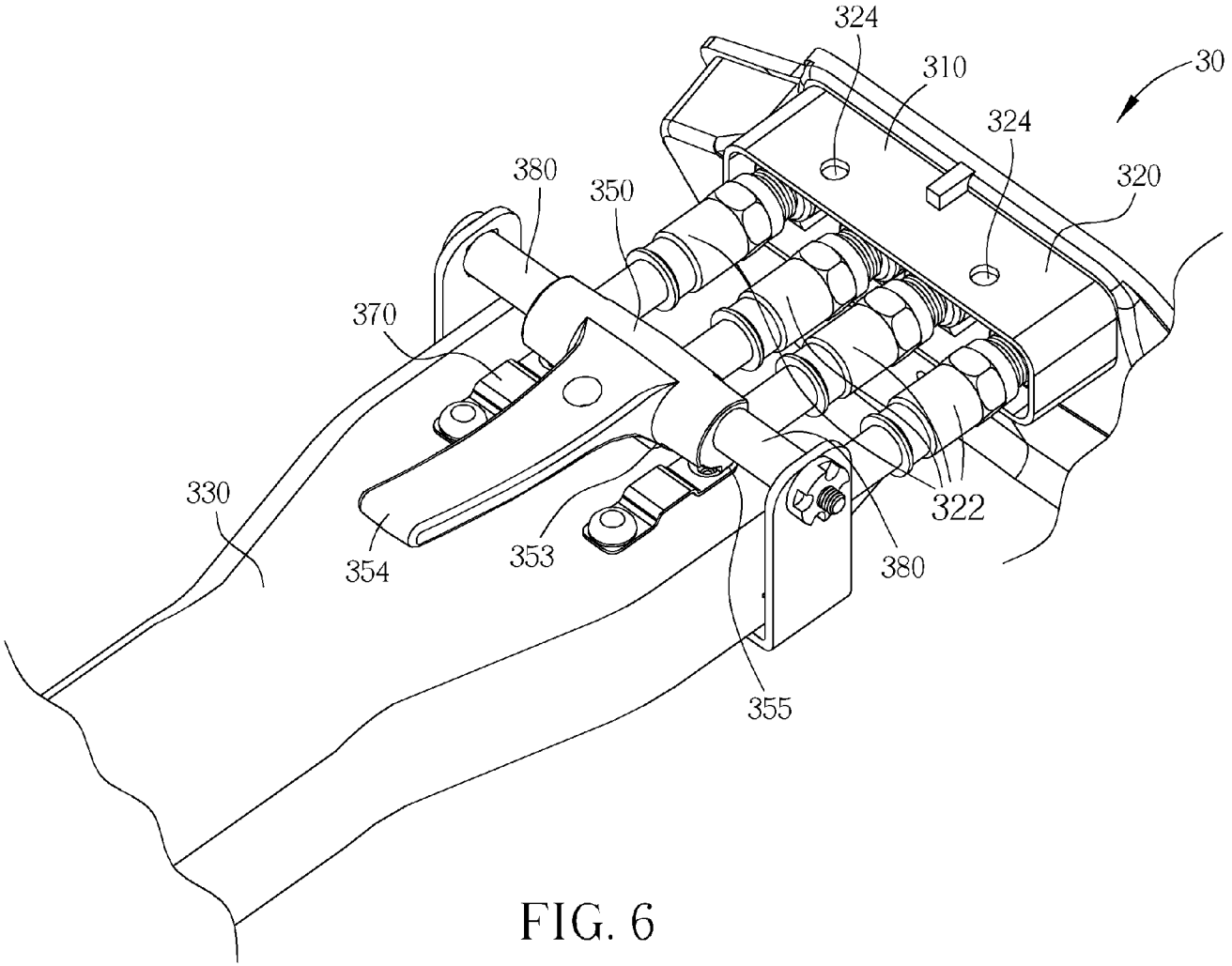
FIG. 6 is a schematic diagram of the LNBF assembly 30 after assembling according to an embodiment of the invention.

In addition, please refer to FIG. 3 and FIG. 6. FIG. 6 is a schematic diagram of the LNBF assembly 30 after assembly according to an embodiment of the invention. The LNBF assembly 30 further includes spacer bushings 380, and each spacer bushing 380 includes a fourth holding hole 382. The spacer bushings 380 are installed between the holder 340 and the holding cam 350, and are utilized for assisting the holding cam 350 in aligning accurately, so that each of the locating protrusions 374 can align completely with the corresponding support arm locating hole 332 and the corresponding LNBF locating hole 324. Moreover, the spacer bushings 380 can assist the holding cam 350 in steady rotation operation without wiggling or sliding motion. For example, as shown in FIG. 6, with the proper design of the spacer bushings 380, the holding cam 350 is capable of being positioned on the top of each of the fixing spring pieces 370. Furthermore, the size of the spacer bushings 380 can be designed in advance according to the relationship between the holding cam 350 and the fixing spring pieces 370 so that the holding cam 350 can align accurately with the locating protrusions 374 after assembly, without consuming extra operation time for alignment. Besides, the spacer bushings 380 and the holding cam 350 can be formed monolithically.

Figure 7:
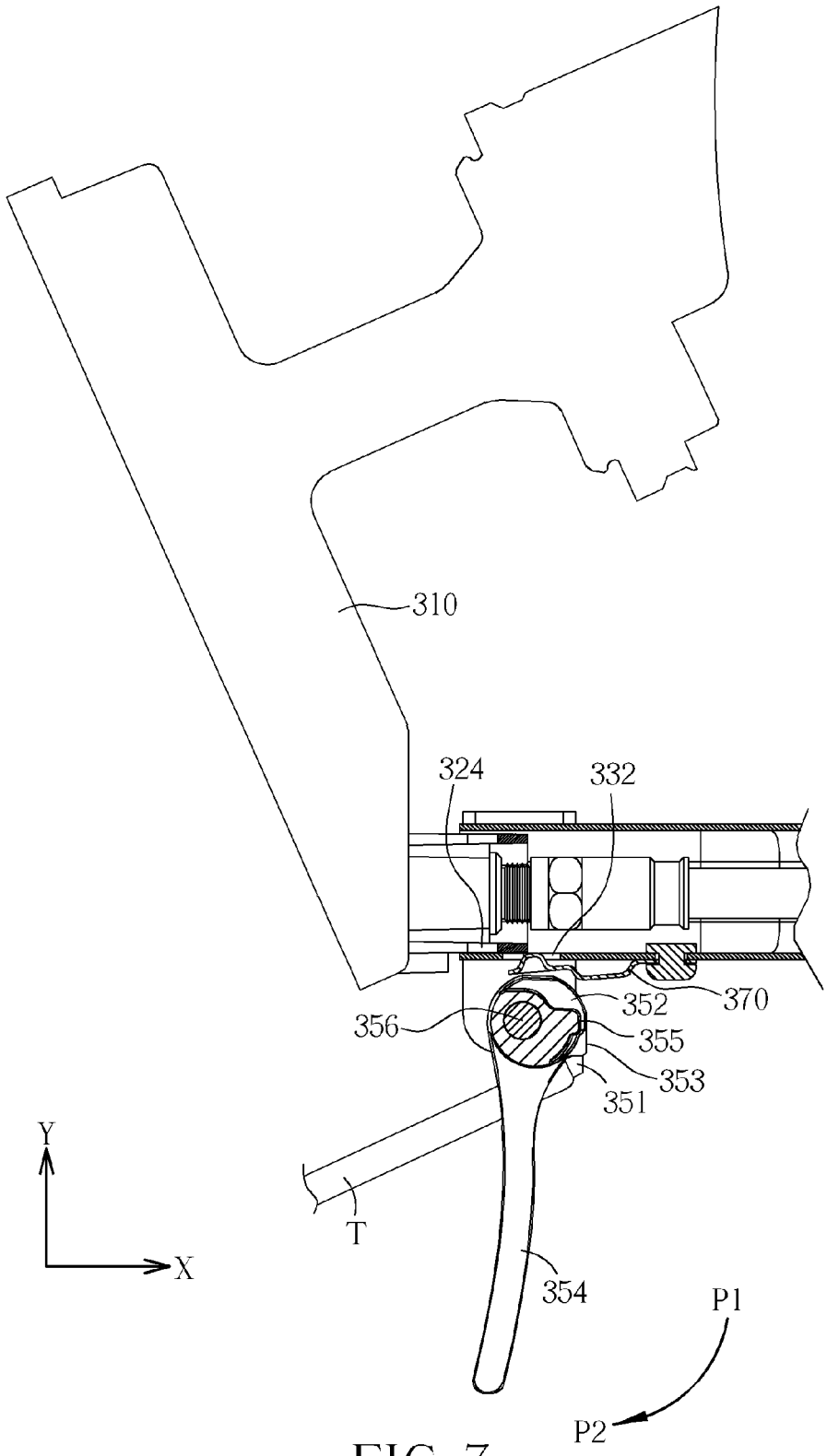
FIG. 7 is a side-view diagram of the connection portion and the support arm shown in FIG. 3 before they are connected.
Figure 8:
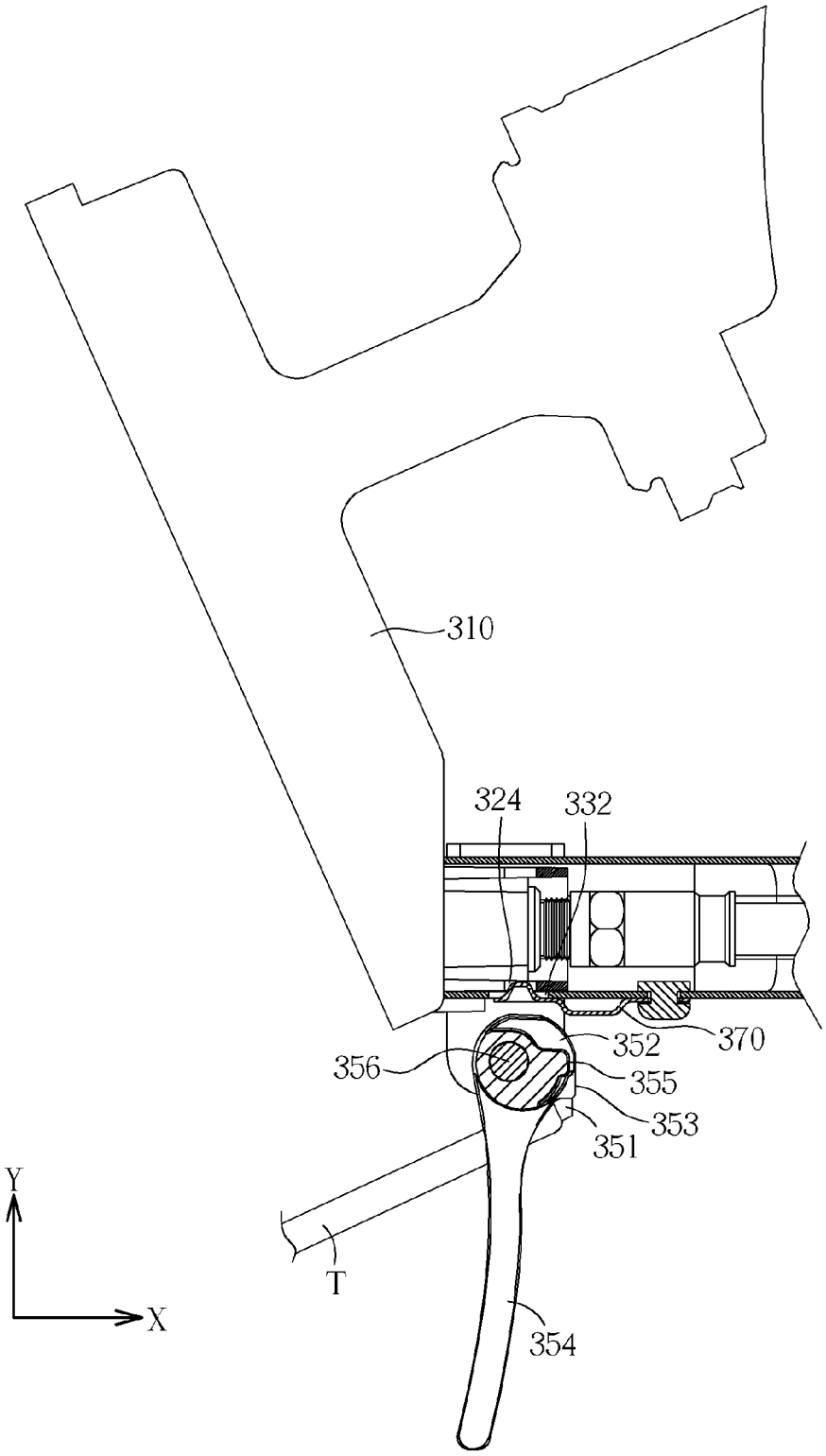
FIG. 8 is a side-view diagram of the connection portion and the support arm shown in FIG. 3 during connecting.
Figure 9:
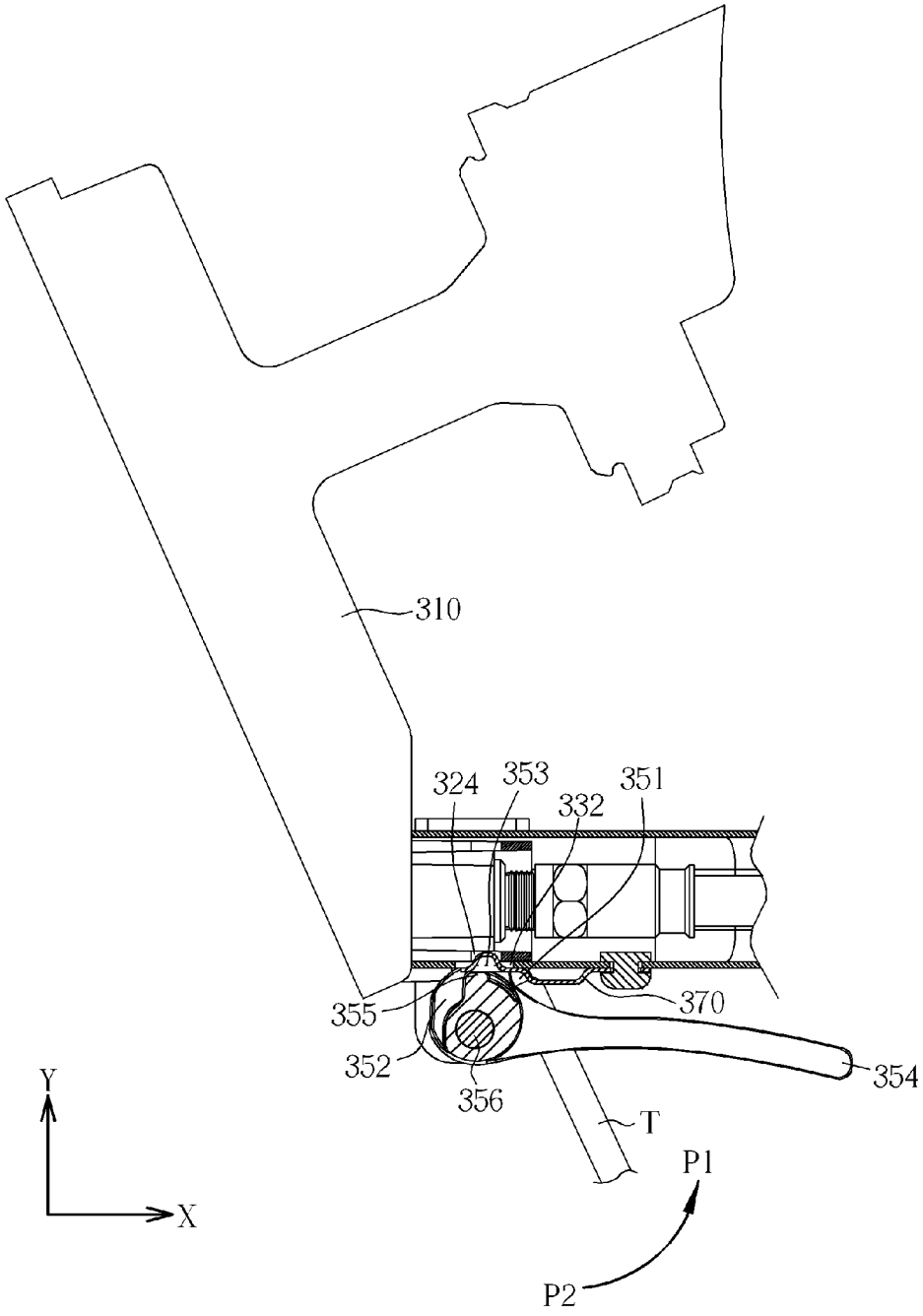
FIG. 9 is a side-view diagram of the connection portion and the support arm shown in FIG. 3 after they are connected and fixed.

Further description associated with the assembly and disassembly of the connection portion 320 and the support arm 330 shown in FIG. 6 follows. Please refer to FIG. 7 to FIG. 9. FIG. 7 is a side-view diagram of the connection portion 320 and the support arm 330 shown in FIG. 3 before they are connected. FIG. 8 is a side-view diagram of the connection portion 320 and the support arm 330 shown in FIG. 3 during connecting. FIG. 9 is a side-view diagram of the connection portion 320 and the support arm 330 shown in FIG. 3 after they are connected and fixed. First, while assembling the connection portion 320 and the support arm 330, a user can operate the auxiliary rod T to drive the shaft end 354 to rotate from a first position P1 to a second position P2 so that the wall thinness portion of the perimeter of the cam end 352 can be rotated to face the support arm 330. At this time, the distance between the perimeter of the cam end 352 and the support arm 330 is long enough so that the locating protrusions 374 can depart from the corresponding support arm locating holes 332 and LNBF locating holes 324 in an unobstructed manner. After that, the connection portion 320 can be inserted into the chamber 334 of the support arm 330 (i.e. the connection portion 320 can be moved forward along the X-axis direction shown in FIG. 7). When a front end of the connection portion 320 contacts the locating protrusions 374, the locating protrusions 374 are able to be forced to depart the chamber 340 of the support arm 330 (i.e. to depart the support arm locating holes 332). In this situation, the connection portion 320 can be pushed into the chamber 334 of the support arm 330 smoothly. Subsequently, as shown in FIG. 8, when each corresponding support arm locating hole 332 aligns with the corresponding LNBF locating hole 324, each of the locating protrusions 374 passes the corresponding support arm locating hole 332 and the corresponding LNBF locating hole 324 with elastic restoring force of the locating spring pieces 370, so as to fix relative position between the connection portion 320 and the support arm 330. In other words, the invention can provide an excellent locating effect through the engaging operation of the locating protrusions 374. Next, referring to FIG. 9, the user can operate the auxiliary rod T to drive the shaft end 354 of the holding cam 350 to rotate from the second position P2 to the first position P1 (i.e. the wall thickness portion of the cam end 352 and the constraining plane structure 353) can be rotated to face to the support arm 330. At this time, the constraining plane structure 353 contacts and completely abuts against the support arm 330. Moreover, the position-limiting structure 355 does not contact the locating spring pieces 370, and a minimum gap exists between the position-limiting structure 355 and the locating spring pieces 370 at this moment, so that the locating protrusions 374 are not capable of departing the support arm locating holes 332 and the LNBF locating holes 324 due to the obstruction of the position-limiting structure 355. As a result, the invention can prevent the locating protrusions 374 from leaving the corresponding support arm locating holes 332 and LNBF locating holes 324 after assembly for secure fabrication purposes. Note that, whether the position-limiting structure 355 (disposed on the perimeter of the cam end 352) requires contact with the locating spring pieces 370 or not depends on overall system design requirements. Similarly, regarding disassembly of the connection portion 320 and the support arm 330, as mentioned before, the shaft end 354 of the holding cam 350 can be rotated from the first position P1 to the second position P2. Then, the connection portion 320 can be pulled out from the chamber 334 of the support arm 330, and the locating protrusions 374 also can be pushed off the corresponding support arm locating holes 332 and the corresponding LNBF locating holes 324 with elastic restoring force. As a result, the invention can assemble and disassemble LNBF components rapidly and securely by simply operating the holding cam 350 having the eccentric cam design.

Figure 10:
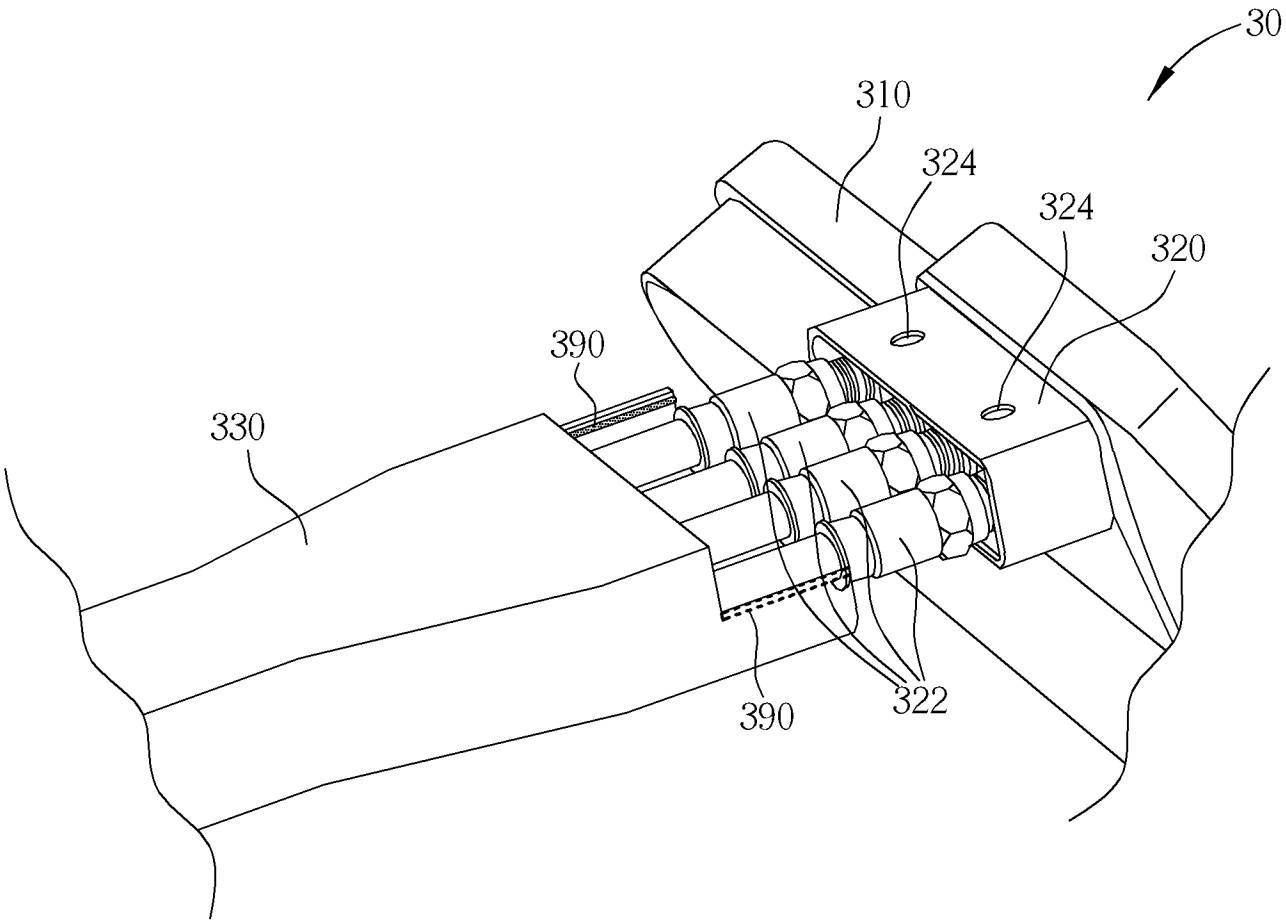
FIG. 10 is an exploded diagram of an inner protrusion structure according to an embodiment of the invention.
Figure 11:
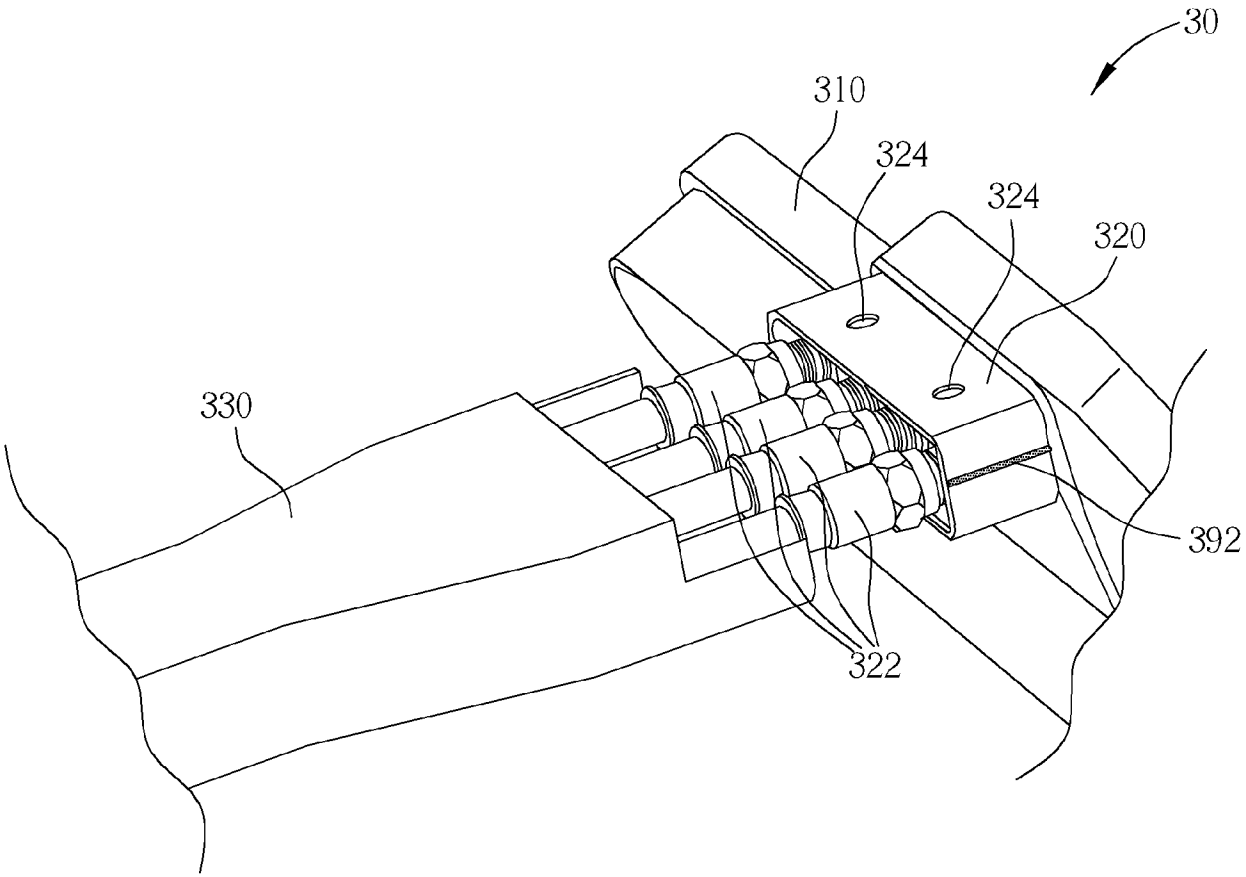
FIG. 11 is an exploded diagram of an outer protrusion structure according to an embodiment of the invention.

On the other hand, please refer to FIG. 10. The LNBF assembly 30 further includes an inner protrusion structure 390 for reducing a gap between the connection portion 320 and the support arm 330 to achieve reliability enhancement of the assembly fabrication. The inner protrusion structure 390 is able to be realized in a protrusion structure on a lateral wall of the chamber 334. For example, the inner protrusion structure 390 can be a rib disposed on the lateral wall of the chamber 334 of the support arm 330. Also, the inner protrusion structure 390 and the support arm 330 can be monolithically formed. Please refer to FIG. 11. The LNBF assembly 30 further includes an outer protrusion structure 392 which is also utilized for reducing gap between the connection portion 320 and the support arm 330. The outer protrusion structure 392 is able to be realized in a protrusion structure on the external lateral wall of the connection portion 320. Certainly, the outer protrusion structure 392 and the connection portion 320 can be monolithically formed.

Note that the LNBF assembly 30 is an exemplary embodiment of the invention, and those skilled in the art can make alternations and modifications accordingly. For example, any shape or material of the LNBF main body 310, the connection portion 320, and the support arm 330 is suitable, such as circular tube shaped, square tube shaped, or any other shape. Each of the components of the LNBF can also be made of different materials, such as the LNBF main body 310 being made of iron material, and the support arm 330 being made of aluminum material. In addition, the embodiment of the invention utilizes two sets of locating protrusions 374 with the corresponding support arm locating holes 332 and the corresponding LNBF locating holes 324 respectively, and this should not be a limitation of the invention. Amount of locating protrusions 374 is dependent upon the corresponding support arm locating holes 332 and the corresponding LNBF locating holes 324. Moreover, the locating spring pieces 370 can be any apparatus having elastic restoring force. The holder 340 can be a U-shaped holder or two L-shaped holders, and formed around the support arm 330 for supporting the holding cam 350 firmly. The holder 340 can be set on the support arm 330 with soldered, engaging, detachable or any other fixing method. Of course, the holder 340 and the support arm 330 can be monolithically formed. Besides, the pivot 360 is designed for connecting the holding cam 350 and spacer bushings 380 to the holder 340, and this should not be a limitation of the invention, any other connection apparatus can be realized for the pivot 360. For example, as shown in FIG. 3, the pivot 360 is realized with a screw 362 and a secure nut 364. Furthermore, the auxiliary rod T can be any apparatus which can realize lever arm force application, such as a rod, a screwdriver, pliers, etc.

In summary, compared with the prior art, the invention provides rapid and secure assembly and disassembly of the LNBF assembly by only simple operations. The invention also utilizes the inner and outer protrusion structures to reduce the gap between the components, so that the invention not only avoids a complicated lockup process, but also achieves the purpose of quick and accurate assembly fabrication.

Those skilled in the art will readily observe that numerous modifications and alterations of the device and method may be made while retaining the teachings of the invention.

What is claimed is:

1. A low noise block down-converter with integrated feed (LNBF) assembly, comprising:

an LNBF main body;

a connection portion extending from the LNBF main body, wherein the connection portion comprises a plurality of signal output units and at least one LNBF locating hole;

a support arm comprising at least one support arm locating hole and a chamber configured to accommodate the connection portion for supporting the LNBF main body by connecting with the connection portion;

at least one locating spring piece, wherein each of the locating spring pieces comprises a fixing end fixed to the support arm and a locating protrusion;

a holder disposed on the support arm comprising a first holding hole and a second holding hole;

a holding cam comprising a cam end, a shaft end, and a third holding hole, wherein the cam end forms an eccentric cam and the holding cam is configured to rotate about an axis to make a perimeter of the cam end approach or leave the support arm when the shaft end is rotated; and a pivot for connecting the holding cam to the holder by passing through the first holding hole, the second holding hole, and the third holding hole;

wherein when the connection portion is inserted into the chamber of the support arm, each of the locating protrusions of the at least one locating spring piece passes through the corresponding support arm locating hole and the corresponding LNBF locating hole to fix relative position between the connection portion and the support arm, and the holding cam is rotated to make the perimeter of the cam end abut against the support arm completely and retain each of the locating protrusions in a penetration state.

2. The LNBF assembly of claim 1, wherein when the connection portion is inserted into the chamber of the support arm and a front end of the connection portion contacts with each of the locating protrusions of the at least one locating spring piece, each of the locating protrusions departs the chamber of the support arm, and when each corresponding support arm locating hole aligns with each corresponding LNBF locating hole, each of the locating protrusions passes through the corresponding support arm locating hole and the corresponding LNBF locating hole to fix relative position between the connection portion and the support arm.

3. The LNBF assembly of claim 1 further comprising:

a constraining plane structure disposed on the cam end; and a position-limiting structure disposed on the cam end;

wherein when each of the locating protrusions passes through the corresponding support arm locating hole and the corresponding LNBF locating hole, the shaft end of the holding cam is rotated from a first position to a second position by an external force to make the constraining plane structure contact and completely abut against the support arm, and each of the locating protrusion is limited to depart the corresponding support arm locating hole and the corresponding LNBF locating hole by the position-limiting structure.

4. The LNBF assembly of claim 1, wherein the holder is formed with a U-shaped holder or two L-shaped holders around the support arm.

5. The LNBF assembly of claim 4, wherein the holder is fixed around the support arm by spot welding or soldering.

6. The LNBF assembly of claim 4, wherein the holder and the support arm are monolithically formed.

7. The LNBF assembly of claim 1, wherein the shaft end of the holding cam comprises an insertion hole for inserting an auxiliary rod for the auxiliary rod to drive the holding cam to rotate about the axis.

8. The LNBF assembly of claim 7, wherein the holding cam further comprises a stop component disposed nearby an opening of the insertion hole for holding the auxiliary rod to limit the position of the auxiliary rod during insertion of the auxiliary rod into the insertion hole.

9. The LNBF assembly of claim 1, wherein the shaft end of the holding cam has a first length and is configured to drive capable of driving the holding cam to rotate about the axis.

10. The LNBF assembly of claim 1 further comprising an inner protrusion structure formed on a lateral wall of the chamber.

11. The LNBF assembly of claim 1 further comprising an outer protrusion structure formed on a lateral wall of the connection portion.

12. The LNBF assembly of claim 1 further comprising:

a first spacer bushing comprising a fourth holding hole; and a second spacer bushing comprising a fifth holding hole;

wherein the pivot passes through the first holding hole, the second holding hole, the third holding hole, the fourth holding hole, and the fifth holding hole for connecting the holding cam, the first spacer bushing, and the second spacer bushing to the holder.

13. The LNBF assembly of claim 12, wherein the holding cam, the first spacer bushing, and the second spacer bushing are monolithically formed.

* * * * *